US010687148B2

(12) United States Patent
Voss et al.

(10) Patent No.: US 10,687,148 B2
(45) Date of Patent: Jun. 16, 2020

(54) ASSEMBLY COMPRISING AN ELECTROSTATIC SOUND GENERATOR AND A TRANSFORMER

(71) Applicant: Sonion Nederland B.V., Hoofddorp (NL)

(72) Inventors: Rasmus Voss, Hoofddorp (NL); Haico van Oosten, Hoofddorp (NL); Camiel Eugène Groffen, Hoofddorp (NL); Laurens de Ruijter, Hoofddorp (NL); Koen van Gilst, Hoofddorp (NL); Frederik Cornelis Blom, Hoofddorp (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 15/419,085

(22) Filed: Jan. 30, 2017

(65) Prior Publication Data

US 2017/0223464 A1 Aug. 3, 2017

(30) Foreign Application Priority Data

Jan. 28, 2016 (EP) ..... 16153086
Feb. 24, 2016 (EP) ..... 16157222

(51) Int. Cl.
*H04R 19/02* (2006.01)
*H04R 19/00* (2006.01)
(Continued)

(52) U.S. Cl.
CPC ..... *H04R 19/02* (2013.01); *H04R 1/24* (2013.01); *H04R 3/14* (2013.01); *H04R 19/005* (2013.01);
(Continued)

(58) Field of Classification Search
CPC ..... H04R 1/24; H04R 1/058; H04R 1/075; H04R 3/06; H04R 3/14; H04R 5/033;
(Continued)

(56) References Cited

U.S. PATENT DOCUMENTS 3,118,979 A * 1/1964 Sessler ..... H04R 19/00 307/400
3,632,903 A 1/1972 Lange
(Continued)

FOREIGN PATENT DOCUMENTS

CN 203788451 U 8/2014
EP 1871141 B1 8/2012
(Continued)

OTHER PUBLICATIONS

Partial European Search Report for Application No. EP 17153723, dated Apr. 12, 2017 (5 pages).
(Continued)

*Primary Examiner* — Huyen D Le
(74) *Attorney, Agent, or Firm* — Nixon Peabody LLP

(57) ABSTRACT

An assembly of a transformer and an electrostatic sound generator is especially efficient if the resonance frequency of the diaphragm is in the frequency range in which the generator is operated, such as in the interval of 1-20 kHz. Then, a smaller transformer with a winding ratio of 5000 or less may be used for feeding the sound generator, making the assembly suitable for hearing aid purposes or in-ear products such as for pro audio use.

14 Claims, 5 Drawing Sheets

(51) Int. Cl.
*H04R 19/04* (2006.01)
*H04R 1/24* (2006.01)
*H04R 3/14* (2006.01)
*H04R 1/10* (2006.01)

(52) U.S. Cl.
CPC ..... *H04R 19/04* (2013.01); *H04R 1/1075* (2013.01); *H04R 2201/003* (2013.01)

(58) Field of Classification Search
CPC ..... H04R 19/013; H04R 19/02; H04R 19/04; H04R 25/604; H04R 2201/003; H04R 1/1075
USPC ..... 381/99, 111, 113, 116, 174, 175, 182, 381/186, 351, 370, 371, 380, 418, 190, 381/191; 307/400
See application file for complete search history.

(56) References Cited

U.S. PATENT DOCUMENTS 3,931,469 A * 1/1976 Elliott ..... H04R 19/02 381/191
3,941,946 A * 3/1976 Kawakami ..... H04R 19/02 381/116
3,943,304 A 3/1976 Piribauer
5,392,358 A 2/1995 Driver
6,788,796 B1 9/2004 Miles et al.
6,831,577 B1 12/2004 Furst
6,853,290 B2 2/2005 Jorgensen et al.
6,859,542 B2 2/2005 Johannsen et al.
6,888,408 B2 5/2005 Furst et al.
6,914,992 B1 7/2005 van Halteren et al.
6,919,519 B2 7/2005 Ravnkilde et al.
6,930,259 B1 8/2005 Jorgensen et al.
6,943,308 B2 9/2005 Ravnkilde et al.
6,974,921 B2 12/2005 Jorgensen et al.
7,008,271 B2 3/2006 Jorgensen
7,012,200 B2 3/2006 Moller
7,062,058 B2 6/2006 Steeman et al.
7,062,063 B2 6/2006 Hansen et al.
7,072,482 B2 7/2006 Van Doorn et al.
7,088,839 B2 8/2006 Geschiere et al.
7,110,560 B2 9/2006 Stenberg
7,136,496 B2 11/2006 van Halteren et al.
7,142,682 B2 11/2006 Mullenborn et al.
7,181,035 B2 2/2007 van Halteren et al.
7,190,803 B2 3/2007 van Halteren
7,206,428 B2 4/2007 Geschiere et al.
7,221,767 B2 5/2007 Mullenborn et al.
7,221,769 B1 5/2007 Jorgensen
7,227,968 B2 6/2007 van Haltren et al.
7,239,714 B2 7/2007 de Blok et al.
7,245,734 B2 7/2007 Niederdraenk
7,254,248 B2 8/2007 Johannsen et al.
7,286,680 B2 10/2007 Steeman et al.
7,292,700 B1 11/2007 Engbert et al.
7,292,876 B2 11/2007 Bosh et al.
7,336,794 B2 2/2008 Furst et al.
7,376,240 B2 5/2008 Hansen et al.
7,403,630 B2 7/2008 Jorgensen et al.
7,415,121 B2 8/2008 Mögelin et al.
7,425,196 B2 9/2008 Jorgensen et al.
7,460,681 B2 12/2008 Geschiere et al.
7,466,835 B2 12/2008 Stenberg et al.
7,492,919 B2 2/2009 Engbert et al.
7,548,626 B2 6/2009 Stenberg et al.
7,657,048 B2 2/2010 van Halteren et al.
7,684,575 B2 3/2010 van Halteren et al.
7,706,561 B2 4/2010 Wilmink et al.
7,715,583 B2 5/2010 Van Halteren et al.
7,728,237 B2 6/2010 Pedersen et al.
7,809,151 B2 10/2010 Van Halteren et al.
7,822,218 B2 10/2010 Van Halteren
7,899,203 B2 3/2011 Van Halteren et al.
7,912,240 B2 3/2011 Madaffari et al.
7,946,890 B1 5/2011 Bondo et al.
7,953,241 B2 5/2011 Jorgensen et al.
7,961,899 B2 6/2011 Van Halteren et al.
7,970,161 B2 6/2011 van Halteren
8,098,854 B2 1/2012 van Halteren et al.
8,101,876 B2 1/2012 Andreasen et al.
8,103,039 B2 1/2012 van Halteren et al.
8,160,290 B2 4/2012 Jorgensen et al.
8,170,249 B2 5/2012 Halteren
8,189,804 B2 5/2012 Hruza
8,189,820 B2 5/2012 Wang
8,223,996 B2 7/2012 Beekman et al.
8,233,652 B2 7/2012 Jorgensen et al.
8,259,963 B2 9/2012 Stenberg et al.
8,259,976 B2 9/2012 van Halteren
8,259,977 B2 9/2012 Jorgensen et al.
8,280,082 B2 10/2012 van Halteren et al.
8,284,966 B2 10/2012 Wilk et al.
8,313,336 B2 11/2012 Bond et al.
8,315,422 B2 11/2012 van Halteren et al.
8,331,595 B2 12/2012 van Halteren
8,369,552 B2 2/2013 Engbert et al.
8,379,899 B2 2/2013 van Halteren et al.
8,509,468 B2 8/2013 van Halteren et al.
8,526,651 B2 9/2013 Lafort et al.
8,526,652 B2 9/2013 Ambrose et al.
2002/0114478 A1 8/2002 Ohashi
2005/0147265 A1 7/2005 Smits
2007/0121969 A1 5/2007 Mayazaki
2007/0154036 A1 7/2007 Matsuzawa
2011/0182453 A1 7/2011 van Hal et al.
2011/0189880 A1 8/2011 Bondo et al.
2011/0299708 A1 12/2011 Bondo et al.
2011/0299712 A1 12/2011 Bondo et al.
2011/0311069 A1 12/2011 Ambrose et al.
2012/0014548 A1 1/2012 van Halteren
2012/0027245 A1 2/2012 van Halteren et al.
2012/0140966 A1 6/2012 Mocking et al.
2012/0155683 A1 6/2012 van Halteren
2012/0155694 A1 6/2012 Reeuwijk et al.
2012/0255805 A1 10/2012 van Halteren et al.
2013/0028451 A1 1/2013 de Roo
2013/0136284 A1 5/2013 van Hal et al.
2013/0142370 A1 6/2013 Engbert et al.
2013/0163799 A1 6/2013 Van Halteren
2013/0195295 A1 8/2013 van Halteren et al.
2014/0064510 A1 3/2014 Grinnip, III

FOREIGN PATENT DOCUMENTS

EP 2512029 A1 10/2012
GB 1494548 A 12/1995
GB 2311682 A 1/1997
JP 11178098 A 2/1999
WO WO 82/00559 A1 2/1982
WO 01/13678 A1 2/2001
WO WO 2010/116006 A2 10/2010
WO WO 2010/116006 A3 10/2010

OTHER PUBLICATIONS

European Search Report for Application No. EP 17153723, dated Jul. 25, 2017 (5 pages).
European Search Report corresponding to European Patent Application No. 16153086.0, European Patent Office, dated Jul. 29, 2016; (3 pages).

* cited by examiner

ASSEMBLY COMPRISING AN ELECTROSTATIC SOUND GENERATOR AND A TRANSFORMER

CROSS-REFERENCE TO RELATED APPLICATIONS

This application claims the benefit of European Patent Application Serial No. 16153086.0, filed Jan. 28, 2016, and European Patent Application Serial No. 16157222.7, filed Feb. 24, 2016, both of which are incorporated herein by reference in their entireties.

FIELD OF THE INVENTION

The present invention relates to an assembly comprising an electrostatic sound generator and a transformer. Sound generators and assemblies of the invention may be used in hearing aids or other sound generators such as headphones or in-ear speakers for e.g. professionals such as musicians. Electrostatic sound generators are known from U.S. Pat. No. 3,943,304 describing a headphone with an electrostatic transducer fed by a transformer, US2014/0064510 describing an electrostatic earphone fed by an amplifier, CN203788451 describing headphones with electrostatic transducers fed by transformers and EP1871141 describing a combination of a tweeter and a woofer.

BACKGROUND OF THE INVENTION

Further technology may be seen in U.S. Pat. No. 3,118,979, US 2002/114478, WO 01/13678, U.S. Pat. No. 5,392,358, JP H11 178098, GB 2 311 682 and US 2007/154036.

Electrostatic sound generators are known to be superior when high frequency audio signals are desired. Electrostatic sound generators however require high voltages which hitherto have been provided using expensive amplifiers or space-consuming transformers.

Electrostatic sound generators usually operate on the basis of a high voltage difference between two back plates between which a diaphragm is fed the audio signal making, the diaphragm moves in accordance with the signal. If only a single back plate is used, the sound generator is denoted "single-sided" and the signal is then fed to one of the diaphragm and the back plate where the other is provided with a biasing charge or voltage.

Single-sided electrostatic sound generators are renowned to have a lot of second order distortion in that the force between the diaphragm and the single back plate varies with the distance between these elements. Aspects of the invention act to reduce these effects by driving the sound generator close to or at its resonance frequency, or rather providing the sound generator so as to have a resonance frequency in the operation frequency range.

SUMMARY OF INVENTION

In a first aspect, the present invention relates to a miniature assembly comprising a transformer and a sound generator, the sound generator comprising a housing, a diaphragm and a back plate, wherein the diaphragm divides an inner space of the housing into a first and a second volume, the back plate is positioned in one of the first and second volumes, the diaphragm has a resonance frequency in the interval of 1-14 kHz, the transformer having a first conductor and a second conductor, the second conductor being connected to the signal generator, the first conductor having a first number of windings and the second conductor having a second number of windings, where a ratio of the first number of windings to the second number of windings is lower than 1:5000.

In this context, a sound generator is a device configured to receive an electrical signal with predetermined frequency contents and output a sound with corresponding frequency contents. Naturally, only some of the frequency contents may be output, as sound generators usually are limited to the audible range of 20 Hz-20 kHz and often much narrower than this. However, within the frequency range inside which the sound generator is configured to operate, the frequency contents preferably correspond to those of the signal input.

A diaphragm is a flexible element provided inside the housing. Naturally, the sound generator may be divided into smaller elements which, when assembled, form the sound generator. One such element may hold the diaphragm and the back plate and perhaps define part of one of the housings, where another part defines part of the other volume.

The diaphragm is electrically conducting or has an electrically conducting portion. Opposed to moving coil/magnet/armature setups, the present diaphragm is driven electrostatically by providing a force between the diaphragm and the back plate. This makes the diaphragm move inside the housing and thus output sound through an output which is usually provided in the housing. The inner side of the housing is divided into two volumes or spaces by the diaphragm. Naturally, the diaphragm may divide the housing into more spaces if desired. A sound output may be provided from one space, multiple spaces or all spaces, depending on the set-up. The outputs may be provided with spouts if desired. So-called vents may be provided from outside the spaces to inside the spaces if desired.

Compared to the diaphragm, the back plate is rigid, so that when a force is provided between the diaphragm and back plate, the diaphragm moves (bends) but not the back plate. The back plate is usually at least substantially parallel to the diaphragm and positioned rather close to the diaphragm, with a distance of no more than 5 mm, such as no more than 3 mm, such as no more than 1 mm, such as no more than 500 μm, such as no more than 300 μm, such as no more than 100 μm, such as no more than 50 μm. Preferably, the back plate is air penetrable in order to not limit the chamber wherein it is positioned. As mentioned above, one or more back plates may be used.

A ratio of the first number of windings to the second number of windings is lower than 1:5000, such as 1:3000 or lower, such as 1:2000 or lower, such as 1:1000 or less, such as 1:500 or less, such as 1:250 or less, such as 1:100 or less.

In this respect, the transformer has the first and second conductors which are preferably not galvanically connected but are preferably arranged so that the primary winding, when receiving a current, outputs a magnetic field which is received by the secondary winding and re-converted into an electrical signal. Usually, the first and second conductors have co-extending windings and/or form windings around a common core, so that the magnetic field of the primary windings is able to reach the secondary windings.

The operation of the transformer is to output from the secondary winding an electrical signal with a higher voltage than the signal input into the primary conductor. The ratio of the voltages is defined by the ratio of the number of windings.

As mentioned above, it is possible to drive the sound generator at or near its resonance peak, whereby less power and/or voltage is required to obtain the desired sound pressure. Thus, the ratio of the winding numbers may be decreased, whereby the transformer may be made smaller relative to the transformers used for electrostatic sound generators operated further away from their resonance frequencies. Electret sound generators may advantageous be operated away from their resonance frequencies.

In one embodiment, the first conductor comprises 10-1000 windings, such as 50-500 windings, such as 75-200 windings, such as 100-150 windings. The second conductor may comprise 1000-100,000 windings, such as 5,000-30,000 windings, such as 10,000-20,000 windings.

The wire diameter of the first and/or second windings may also be made thinner, when less power is required. Naturally, the power required depends on the size of the sound generator and the sound pressure level or amplitude desired. For hearing aid implementations and/or miniature assemblies, the wire diameter may be 50 μm or less. Usually, the secondary conductor has a lower wire diameter than that of the first conductor. The second conductor may have a wire diameter of 30 μm or less, such as 25 μm or less, such as 20 μm or less, such as 15 μm or less. The first conductor may have a wire diameter of 20-100 μm, such as 30-70 μm, such as 45-55 μm.

Also, it is normally desired that the transformer does not take up more space than required. As mentioned above, the invention aims at manners of reducing the requirements to the transformer which, accordingly, may be made smaller. Preferably, especially in miniature assemblies such as miniature hearing aid or earbud embodiments, the transformer has an overall volume of no more than 300 mm3, such as no more than 250 mm3, such as no more than 200 mm3.

Especially in miniature hearing aid or earbud situations, it is desired that the miniature assembly with the sound generator is small. In one situation, the sound generator housing may, especially if the transformer is not provided therein, have a volume of no more than 100 mm3, such as no more than 70 mm3, such as no more than 50 mm3, such as no more than 30 mm3.

In the situation where the transformer is provided in the sound generator housing of the miniature assembly, the volume thereof may be no more than 500 mm3, such as no more than no more than 400 mm3, such as no more 350 mm3, such as no more than 300 mm3, such as no more than 225 mm3.

The resonance frequency may be determined in any desired manner. It may also be calculated if desired. The diaphragm may have multiple resonance frequencies, some of which may be outside of the above frequency interval.

Preferably, the resonance frequency is in the interval of 1-14 kHz, such as in the interval of 2-12 kHz, preferably in the interval of 5-10 kHz.

In one embodiment, the back plate is a single back plate, so that the sound generator has only a single back plate. Thus, the sound generator is a so-called single-sided device.

In usual single-sided sound generators, this brings about the challenge that the force acting on the diaphragm differs with the distance between the diaphragm and the back plate. Thus, a non-linear displacement is seen, resulting in a second harmonic distortion. However, this effect is reduced when the diaphragm has a resonance frequency at or close to the frequency at which it is operating. The reason is that at the resonance frequency, the diaphragm's own motion will assist the movement intended by the applied signal instead of interfering with it.

Then, the sound generator may further comprise a signal input and a conducting area provided on or in one of the back plate and the diaphragm, the conducting area comprising a charge, where the signal input is connected to the other of the back plate and the diaphragm. The signal input is connected to the second conductor.

The charge may be provided in a number of manners. One manner is the charging of an isolated electrically conducting element which is electrically or galvanically isolated from other elements of the sound generator (or anything else). In this situation, the charge may remain (be permanent or semi-permanent) and act to bias the diaphragm in relation to the back plate. This element may be fully embedded in non-conducting material, such as when moulded between sheets of plastic/polymer, or it may be provided on the surface of a non-conducting element.

Preferably, only one secondary winding is used or connected to a sound generator, so that a sound generator is fed only by the second conductor of a transformer. A transformer may have multiple secondary windings each feeding a sound generator.

In another situation, the charge is a biasing DC voltage applied to the electrically conducting element or surface so as to maintain the voltage level thereof with a DC voltage which will bring about the same effect. This DC signal may be fed to the conductive area via another signal or voltage input. This DC signal may be derived from a battery and/or other power source also feeding the same voltage or about the same voltage, for example, to a signal emitter (see below).

The input signal is then fed to the other of the diaphragm and back plate. As this input signal varies (it represents an audio signal), the resulting charge or voltage of the element to which it is connected will change. The voltage/charge of the conducting area will then create a varying force between the diaphragm and back plate, whereby the diaphragm will vibrate accordingly. Therefore, sound is generated.

In another embodiment, the sound generator further comprises a second back plate positioned in the other of the first and second volumes, the diaphragm being positioned between the back plate and the other back plate. The above features of the other back plate are relevant also to the second back plate.

In this situation, the sound generator may further comprise an inverting circuit and, as described in relation to the above single-sided generator, a signal input and a conducting area/element comprising a charge/voltage. In this embodiment, the conducting area is provided on or in a first of the diaphragm, the back plate and the second back plate, the signal input is connected to a second of the diaphragm, the back plate and the second back plate, and the inverting circuit is connected between the signal input and a third of the diaphragm, the back plate and the second back plate. Alternatively, a second signal input may be provided for receiving an inverted input signal.

The inverting circuit may be extremely simple. All it needs to do is to provide an inverted version of the input signal, i.e. an inverted signal which is negative when the input signal is positive and vice versa.

Thus, the conducting area may be provided on any of the three elements, and the input signal and inverted signal may be provided on any of the other two elements. This is described below.

In an alternative embodiment, the sound generator further comprises a signal input, a first conducting area comprising a first charge and a second conducting area comprising a second charge. In this embodiment, the first conducting area is provided on or in a first of the diaphragm, the back plate and the second back plate, the signal input is connected to a second of the diaphragm, the back plate and the second back plate, and the second conductive element is provided on or in a third of the diaphragm, the back plate and the second back plate.

The first and second charges/voltages may have opposing signs or at least different values in Volts or Coulomb depending on whether the charge is (semi) permanent or provided by a DC voltage.

It is preferred that a resonance peak at the resonance frequency has a Q-factor of at least 3, such as at least 4, such as at least 5, such as at least 7, such as at least 10. The larger the Q-factor, the higher and more narrow the peak. A high Q-factor aids in the operation of the sound generator close to or at the resonance frequency. The Q-factor is determined as $Q=fc/(f2-f1)$ where fc is the centre frequency of the resonance peak, f2 the upper frequency and f1 the lower frequency at half maximum (FWHM frequencies; −3 dB from the maximum value) of the peak.

In general, driving a diaphragm within a frequency interval away from its resonance frequency requires using a certain amount of force to overcome the load of the diaphragm. Driving the diaphragm close to or at the resonance frequency, the load of the diaphragm is lower, facilitating the driving thereof.

Thus, the resonance frequency is preferably chosen within a frequency interval within which the sound generator is operated—i.e. within which signals fed to the sound generator comprise frequencies or energy.

The assembly may further comprise a signal emitter configured to emit to the first conductor a signal with a frequency in the interval of 1-20 kHz, such as 2-20 kHz, such as 5-20 kHz, such as 6-15. Preferably, the resonance frequency is within the frequency interval. Even more preferably, the frequency interval is from about 2 kHz below the resonance frequency and upwards.

In this context, the signal emitter may be configured to output a signal with additional frequency contents, such as outside of the above frequency interval. Usual audio signals have frequency contents in the interval of 20 Hz-20 kHz, which is a much broader interval also comprising low frequency portions. In this situation, the lower frequency portions, such as frequencies outside of the interval, are removed or reduced (such as to a level or intensity below a predetermined value) in order to not be fed to the sound generator, as the driving of the sound generator at frequencies further from, such as further below, the resonance frequency, as described, requires more energy.

The signal emitter may receive a signal which it will then output to the first conductor. This received signal may be an audio signal from a microphone or an audio source, such as streamed audio, stored audio signals in the signal emitter or accessible thereby. Thus, the signal emitter may further comprise means for receiving or accessing an audio signal and for processing this signal in any way before emitting it to the first conductor Thus, if the signal received by the first conductor and signal emitter has frequencies below the lower frequency of the interval, a filter (such as a high pass filter), a limiter, an equalizer or the like may be provided for removing such low frequency contents before feeding the resulting signal to the first conductor.

Naturally, additional sound generators may be connected to the transformer. In one embodiment, the assembly further comprises a second sound generator comprising a second housing, a second diaphragm and a second back plate, wherein the second diaphragm divides an inner space of the second housing into a third and a fourth volume, the second back plate is positioned in one of the third and fourth volumes, the second diaphragm has a resonance frequency in the interval of 1-14 kHz, the transformer having a third conductor having a third number of windings, a second ratio of the first number of windings to the third number of windings being lower than 1:5000.

Naturally, the above advantages of the winding parameters are equally relevant in relation to the second sound generator.

Alternatively, the second sound generator may be connected to the second conductor and thus be connected in series or in parallel to the first sound generator.

An advantage may be seen when the second and third conductors have different windings. The number of windings defines the output level of a sound generator, and the sound output levels of the sound generators may be adapted simply by providing different numbers of windings of the respective secondary windings.

Thus, the assembly may further comprise a low frequency sound generator, the low frequency sound generator being configured to output sound in the frequency interval of 20 Hz-10 kHz. Usually, low frequency sound generators are configured to output sound in the interval of 20 Hz-2 kHz, such as 20 Hz-1 kHz or even lower, such as 20 Hz-500 Hz.

Then, the assembly could further comprise a medium frequency sound generator, the medium frequency sound generator being configured to output sound in the frequency interval of 200 Hz-12 kHz, such as in the interval of 250 Hz-5 kHz, such as 250 Hz-2 kHz. When multiple sound generators are provided, the signal generator may generate separate signals for each sound generator. The signal generator may have therein e.g. a filter or the like for generating different signals to different sound generators. Alternatively, the same signal may be fed to multiple sound generators. Some sound generators are very inefficient as frequencies away from the interval in which the sound generator is adapted to output sound, so that even if the signal fed to the sound generator having such "outlier" frequencies, this will not interfere with the desired operation of the sound generator.

In one embodiment, the assembly further comprises a third housing comprising therein the housing and the second housing and having a sound outlet.

A second aspect of the invention relates to a method of operating the assembly according to the first aspect, the method comprising feeding to the first conductor an electrical signal comprising at least a portion within the frequency interval of 1-20 kHz, i.e. a signal at or in the vicinity of the resonance frequency. As mentioned, the signal fed to the signal generator preferably has a high voltage, such as with peaks of at least 30V, such as at least 50V, such as at least 75V, such as at least 100V.

As mentioned above, the feeding step may comprise transforming a low voltage signal, such a signal output of a usual amplifier with an operating voltage below 100V, such as below 10V, such as below 5V, to a transformer increasing the voltage preferably by several orders of magnitude.

Naturally, a high voltage signal may be obtained using also high voltage amplifiers which are capable of amplifying a low voltage signal into a high voltage signal.

The feeding of a signal within this interval or the more narrow intervals described further above will bring about the advantages described above.

As mentioned, the feeding step may comprise removing or damping undesired portions of a signal in order to not have frequencies below 2 kHz below the resonance frequencies. In this context, this may mean that a signal amplitude of any frequency below the above limit may be completely removed or at least reduced to be at least an order of magnitude lower (reduced −3 dB or more) than a signal amplitude of a frequency within the interval.

When the sound generator is operated at or in the vicinity of the resonance frequency, the assembly is extremely efficient. One manner of quantifying efficiency is to correlate the signal strength of sound generated from a predetermined signal voltage provided to the primary winding of the transformer. This sound may be determined in a predetermined volume or chamber type, such as a hard-walled cylindrical cavity having a diameter of 18.55 mm and a length of 6.6 mm, where the sound is output into this cavity at one end thereof and the sound pressure measured at the other end thereof. Preferably, the sound pressure is at least 80 dB/V of the signal input into the primary winding. Naturally, a higher efficiency such as one resulting in at least 85 dB/V or at least 90 dB/V or at least 95 dB/V or at least 100 dB/V or at least 110 dB/V may be obtained.

Naturally, the electrical signal fed may be a low voltage signal, as described above, with a maximum voltage below 100V, such as below 10V, such as below 5V.

Also, the assembly, as mentioned above, preferably has at least a portion, such as a spout, with a sound output and which is dimensioned to be positioned at the ear canal or in the ear canal of a person. Thus, a largest dimension, perpendicular to the direction into the ear canal, of no more than 9 mm, such as no more than 8 mm, such as no more than 7 mm, such as no more than 6 mm, such as no more than 5 mm, such as no more than 4 mm is preferred.

A third aspect of the invention relates to a miniature assembly comprising an electrostatic sound generator and a transformer having a first and a second conductor, the second conductor connected to the sound generator, the sound generator having a housing, back plate and a diaphragm, the housing having a portion configured to be positioned at or in an ear canal of a person, the sound generator having a sound output in the portion, the assembly being configured to, when an AC signal is fed to the first conductor and a sound signal is fed from the sound output into one end of a cylindrical cavity with a diameter of 18.55 mm and a length of 6.6 mm, output a sound having, at the other end of the cavity, at least 80 dB/V.

Naturally, this aspect of the invention may be combined with any of the other aspects and embodiments, so that the voltage provided to the first conductor may e.g. be a low voltage. Also, the cylindrical cavity preferably is a hard-walled cavity, such as a cavity, the walls of which are made of hard plastics/polymer/resin/metal or the like, so that no substantial sound absorption takes place by the walls.

Also, the housing or at least the portion is dimensioned to be provided in an ear canal of a person. Thus, a largest dimension, such as a diameter, of the housing or portion perpendicular to the direction of the ear canal is no more than 9 mm, as is described above. Thus, the housing or portion may have a dimension longer than the 9 mm, as long as the housing or portion is configured to have this dimension along the direction of the ear canal.

Products of this type may be hearing aids or earbuds used also for providing sound to a person's ear but not necessarily a hearing impaired person. The products have a portion extending toward and preferably into the ear canal of the person to deliver the sound directly to the ear canal. Often, the hearing aid or earbud may have a portion also outside of the ear canal, where the portion then has a sound guide or tube extending into the ear canal.

In the present context, the efficiency of the at least 80 dB/V is seen at at least one frequency in the interval of 1-20 kHz but preferably is seen in a frequency interval with a frequency difference between the highest and lowest frequency of at least 1 kHz, such as at least 2 kHz, such as at least 5 kHz, such as at least 10 kHz, such as at least 15 kHz. Preferably, this efficiency is seen in all of the frequency interval of 1-20 kHz.

Another aspect of the invention relates to an assembly comprising:

- a first sound generator having:
- a first housing,
- a first diaphragm dividing an inner space of the first housing into a first and a second volume,
- a first sound output opening into one of the first volume and the second volume, and
- a first sound input opening into one of the first volume and the second volume,
- a second sound generator having:
- a second housing,
- a second diaphragm dividing an inner space of the second housing into a third volume and a fourth volume,
- a second sound output configured to guide sound from one of the third volume and the fourth volume to the first sound input, and
- a second sound input opening into one of the third volume and the fourth volume, and
- a third sound generator having:
- a third housing,
- a third diaphragm dividing an inner space of the third housing into a fifth volume and a sixth volume and
- a third sound output configured to guide sound from one of the fifth volume and the sixth volume to the second sound input.

Thus, the third sound generator outputs sound via the second and first sound generators and the second sound generator outputs sound via the first sound generator.

Sound may enter and exit a sound generator to/from the same volume or different volumes. Sound may enter one volume and travel to the other volume of the sound generator via the diaphragm. It is, however, preferred that the sound enters the same volume as it exits from.

As mentioned above, a diaphragm may divide a sound generator into more than two volumes, and a sound generator may be provided as multiple parts which when assembled form the sound generator. One part usually has the diaphragm.

The sound generators may be of any desired type, such as the miniature sound generators described and/or an electrostatic sound generator, a moving armature generator and a moving coil armature.

The three sound generators may be of the same technology (electrostatic, moving armature, moving coil) or at least two of the sound generators may be of different technologies.

For example, the third sound output may be positioned close to the second sound input so as to ensure that sound exiting the third sound output enters the second sound input. Alternatively, a sound guide could be provided for guiding sound from the third sound output and to the second sound input. In the same manner, the second sound output may be provided close to the first sound input and/or a guide may be provided for guiding sound from the second sound output to the first sound input.

The resonance frequency of a sound generator may be, as is described above, adapted by adapting the stiffness/weight of the diaphragm, the sizes of the volumes of the sound generator but also, in this aspect, of the sizes of the volumes through which the sound must travel to the first output and any tubes or guides provided between the sound generators.

In yet another aspect the invention relates to an assembly comprising a first and a second sound generator as described in relation to the first aspect and a third housing having a sound outlet, the first and second sound generators positioned in the third housing. This has the advantage that the sound generators output sound from a single sound output. This sound output may be provided with a spout if desired.

In a final aspect the present invention relates to a personal listening device comprising the assembly according to at least one of the previous aspects.

BRIEF DESCRIPTION OF THE DRAWINGS

In the following, preferred embodiments of the invention will be described with reference to the drawing, wherein.

DETAILED DESCRIPTION OF THE INVENTION

Figure 1:
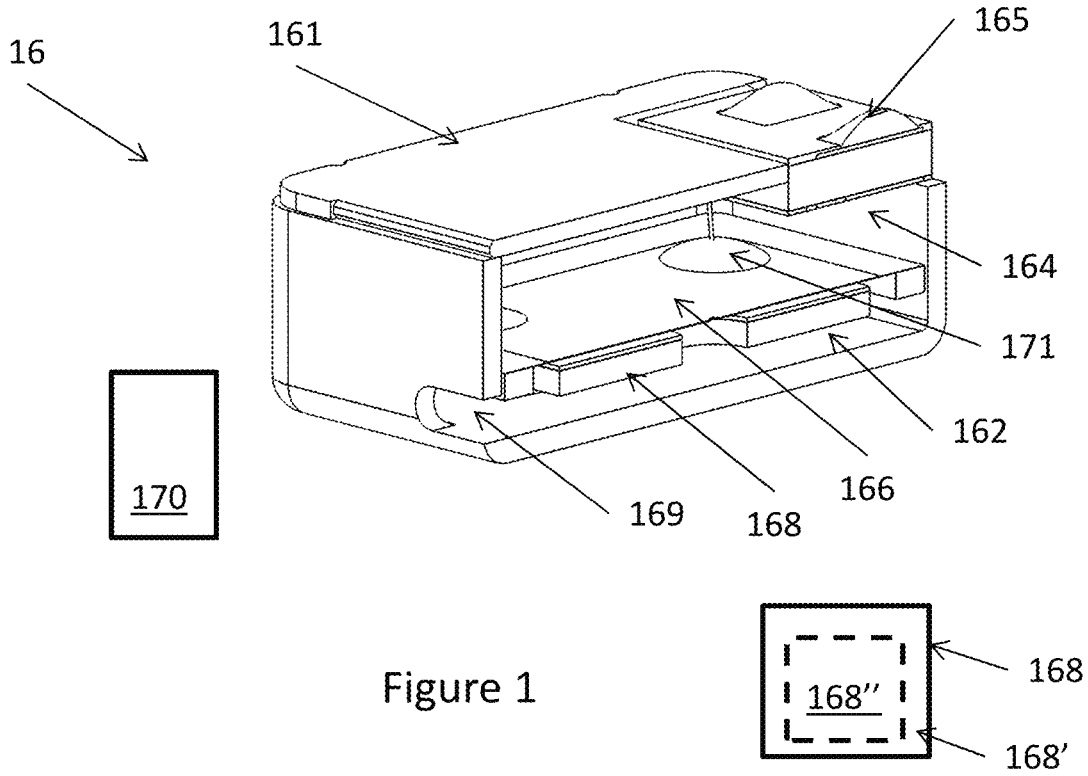
FIG. 1 illustrates an electrostatic sound generator

In FIG. 1, a standard electrostatic sound generator 16 is illustrated having a housing 161, the inner space thereof being divided into two chambers 162 and 164 by a diaphragm 166. The housing 161 has a sound output 169 for outputting sound from the space 162, which usually is denoted a front chamber, where the space 164 then is denoted a back chamber. The back chamber may be completely sealed, may have a so-called vent, or may have a sound output of its own.

A back plate 168 is illustrated being positioned in the front chamber 162. It may equally well be positioned in the back chamber 164. The back plate is positioned parallel to and rather close to the diaphragm and is usually provided with a number of openings so that air may pass through it and into the remainder of the chamber 162. However, naturally, the back plate may be non-perforated and form a wall or inner surface of the chamber in which the back plate is provided.

The sound generator operates by a force being applied between the diaphragm and back plate. There are a number of manners of obtaining this.

In the art, electrostatic generators as that illustrated in FIG. 1 is called "single sided" in that only a single back plate is used.

In this set-up, the force is generated by adding a charge to one of the back plate and the diaphragm and the input signal, such as input via connection 171 to inputs 165, to the other. The voltage of the signal applied will change the resulting charge of the other of the diaphragm and the back plate and will thus vary the overall force caused by the difference in charge of these two elements.

The charge added to the back plate or diaphragm may be provided by permanently or semi permanently charging an isolated conducting element of the diaphragm or back plate. This is illustrated in FIG. 1 where the back plate 168 has a non-conducting portion 168' in the centre of which a conductive portion 168" is provided. When this conducting element is isolated (electrically and/or galvanically) from other elements of the sound generator (and preferably everything else), it will retain this charge. Alternatively, a DC voltage may be fed to the conducting element of this diaphragm/back plate. The permanent charging of the element has the advantage that no electrical connection is required to that element. A disadvantage is that a so-called collapse, where the back plate and diaphragm touch, so that the charge is removed, may cause the generator to no longer function optimally.

Alternatively, the input signal may also be fed to the other of the diaphragm/back plate but in an inversed manner, so that when the input signal fed to a first one of the diaphragm/back plate is positive, the signal fed to the other one is negative. Thus, the force will vary over time and will resemble the input signal.

Naturally, an additional back plate (not illustrated) may be used and positioned in the back chamber 164. This is the usual manner of providing an electrostatic sound generator.

In this manner, again, multiple manners of operation are possible. In one manner, a permanent or semi-permanent charge is provided to the diaphragm. Alternatively, a DC voltage is applied thereto. Then, the input signal is fed to one back plate and inversed to the other. When one back plate is positive and the other negative, the charge of the diaphragm will move the diaphragm away from one back plate and toward the other.

Alternatively, a DC voltage may be provided to the back plates (positive to one and negative to the other—or more positive on one and less positive on the other or the like), where the input signal is then fed to the diaphragm. The same overall result is seen.

Naturally, a combination may be used where charges or DC values are provided to the diaphragm and one back plate and the input signal to the other back plate.

The resonance frequency of the diaphragm is easily determined either empirically or theoretically. In addition, a resonance frequency is characterized also by a Q value describing how tall and slim the peak is. The higher the Q value, the sharper and taller the resonance peak. The Q-factor is determined as $Q=fc/(f2-f1)$ where fc is the centre frequency of the resonance peak, f2 the upper frequency and f1 the lower frequency at half maximum (FWHM frequencies; −3 dB from the maximum value) of the peak.

The resonance frequency may be altered or adapted by amending or altering the mass or stiffness of the diaphragm, for example. Usually, a diaphragm is formed by a laminate of different materials, some electrically conducting and others not. More or less layers, thicker or thinner, will alter the resonance frequency. This is known to the skilled person.

Figure 6:
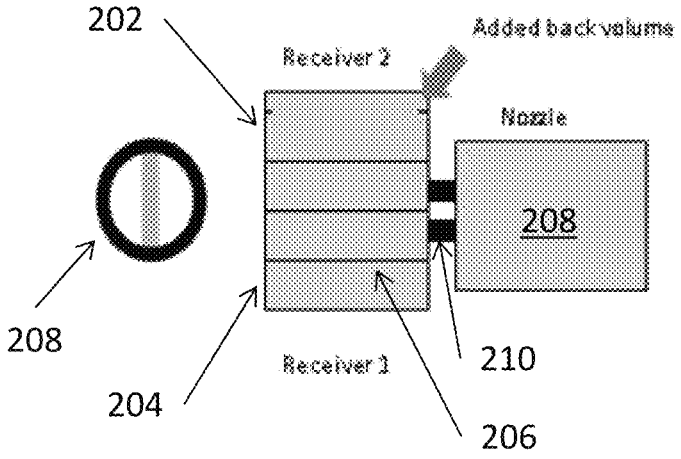
FIG. 6 illustrates a first manner of altering a resonance frequency of a sound generator
Figure 7:
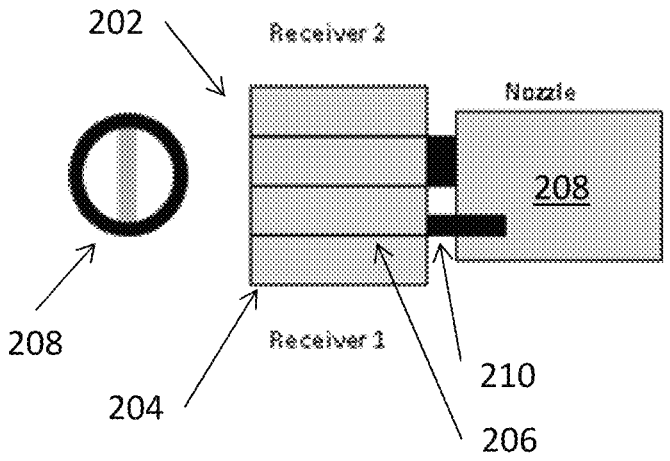
FIG. 7 illustrates a second manner of altering a resonance frequency of a sound generator and FIG. 8 illustrates a third manner of altering a resonance frequency of a sound generator.
Figure 8:
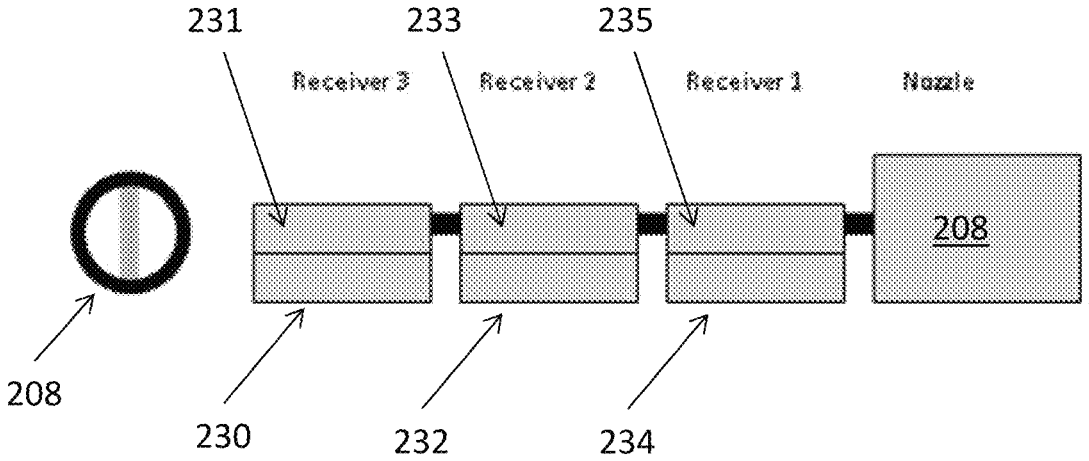

Other manners of altering a resonance frequency are seen in FIGS. 6-8. In FIG. 6, two receivers 202/204 are seen each having a diaphragm of which the diaphragm 206 is pointed to. The upper receiver 202 has an enlarged back volume (upper compartment) whereby the receiver, all other dimensions being equal, has a lower resonance frequency. Another manner of obtaining the same volume increase would be to provide an opening in the chamber to be increased and provide e.g. a tube or the like into which can also travel. This tube may be closed or open at the opposite end.

The receivers 202/204 have sound outputs outputting sound into tubes 210 and further into an individual lumen of a two-lumen nozzle 208. To the left in the figure a cross section of the nozzle 208 is seen. Alternatively, the tubes 210 may be omitted and the sound emitted directly from the receivers 202/204 into the nozzle lumens.

In FIG. 7, another set-up is seen with two receivers 202/204 with diaphragms. The two receivers here may have identical dimensions but the tubes 210 now have different dimensions or loads. The upper tube is shorter and fatter whereas the lower one is longer and slimmer. This effectively gives the two receivers different resonance frequencies. Again the sound is fed from the tubes into a nozzle 208. Naturally, the tubes may be omitted and the lumens of the nozzle adapted to give the receivers different resonance frequencies.

In FIG. 8, a different manner of adapting a resonance frequency is seen. Three receivers 230/232/234 are provided in series so that the receiver 230 outputs sound into the front chamber 233 of the receiver 232 which again outputs the combined sound thereof into the front chamber 235 of the receiver 234 outputting the sound to the nozzle 208 which may be omitted if desired.

The receiver 230 will have a higher acoustic mass than the other receivers and thus, all other dimensions being equal, have a lower resonance frequency. The receiver 232 will, again all other dimensions equal, have a resonance frequency between those of receivers 230 and 234. Naturally, sound may instead be input into the back chamber of a receiver where it is then fed via the diaphragm to the sound output of that receiver. It is noted that this manner of adapting the resonance frequencies while outputting the resulting sound from multiple receivers from a single output. This technology is not limited to electrostatic receivers as the resonance frequency of any sound generator may be adapted as illustrated in FIGS. 6-8.

Figure 2:
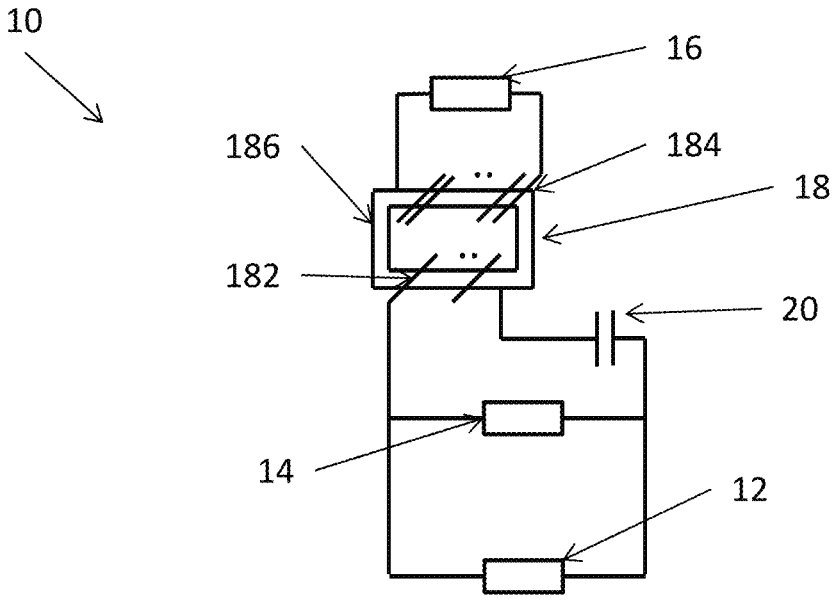
FIG. 2 illustrates a circuit for feeding an electrostatic sound generator and a second sound generator

In FIG. 2, a set-up of an electrostatic sound generator 16 is seen which is fed by a signal source 12, such as a source of an audio signal, which outputs a signal for a low frequency sound generator 14 and the sound generator 16, which is intended to output only or primarily high frequencies. The signal output by the source 12 may be a standard audio signal comprising frequencies in the interval of 20 Hz-20 kHz.

In this context, the sound generator 14 is connected to the source 12 and receives the signal output therefrom. Also, coupled in parallel to the generator 14 is an assembly of a capacitor 20 and a transformer 18 having a primary winding 182 with a first number of windings around a core 186. The transformer has a secondary winding 184 with a second number of windings and which is connected to the high frequency sound generator 16.

In one embodiment, the transformer has 125 primary windings with a wire diameter of 48 μm and 14250 secondary windings with a wire diameter of 12 μm. The transformer diameter is 10 mm and a width/thickness is 2.6 mm.

A preferred capacitance of the capacitor is 4.7 μF. The resistance of the primary coil and the capacitance of the capacitor determines the −3 dB point of the high pass filter created thereby.

The function of the capacitor 20 is to remove or reduce low frequency signals from the signal fed to the transformer 18. When only the higher frequency frequencies reach the transformer 18, this transformer may be made of thinner conductors and thus be made smaller.

Naturally, a low pass frequency filter may be provided in series with the generator 14, if this generator is not itself either able to output the higher frequency sounds or handle the higher frequency signals. Usually, there is not much power in such higher frequency signals, so ordinary lower frequency generators, such as ones based on balanced armature, moving armature, moving coil technologies or the like, may be fed the full signal frequency spectrum and will output only the lower frequencies thereof. Balanced armature generators, for example, may be suited to output only frequencies below e.g. 6 kHz, independently of whether the signal fed thereto comprises also frequencies above that limit. Another suitable type of low frequency sound generator, or woofer, is a dynamic driver speaker also called a moving coil transducer. Electrostatic sound generators may also be used as low frequency speakers if desired.

Naturally, additional sound generators may be added to the set-up. Another low frequency generator—or a medium range generator—may be provided in parallel with the generator 14—potentially in series with a filter if desired.

Suitable midrange speakers may be based on any the moving armature, the moving coil or the electrostatic principle.

For example, a combination of a balanced armature or moving coil woofer and electrostatic tweeter can be expanded by a balanced armature midrange. The use of two loudspeakers for woofer and midrange allows more control of the frequency response and can therefore provide better sound quality. The woofer and midrange can either be different receivers, or they can be similar receivers tuned differently acoustically. Naturally, a moving coil midrange could be used instead of the balanced armature midrange.

Alternatively, the combination of a balanced armature or moving coil woofer and electrostatic tweeter can be expanded by a second electrostatic midrange driver. This gives more control of the frequency response, and increases the range of frequencies where the high sound quality of the electrostatic tweeter is used. The two electrostatic loudspeakers can be driven by the same transformer coil, or by two separate coils on the same transformer, or by two separate transformers.

An additional high frequency generator may also be provided, such as multiple electrostatic drivers with essentially equal frequency response. The advantage is that they can produce the same sound pressure level at lower voltage than a single electrostatic driver, thereby reducing the requirements for the transformer, or even making it obsolete. It also increases the maximum achievable sound pressure level. The electrostatic drivers can either have separate spouts or share a single spout.

Figure 5:
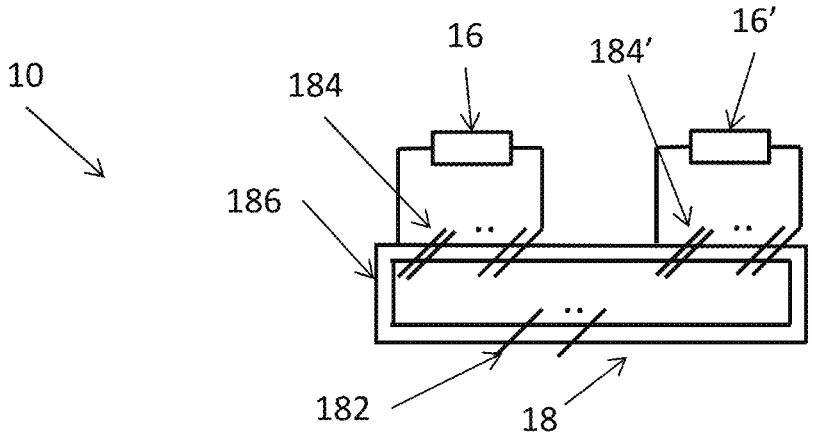
FIG. 5 illustrates multiple electrostatic sound generators fed by the same transformer

An additional electrostatic receiver may be connected to the second conductor/winding 184, or the transformer 18 may have another secondary winding to which the extra high frequency generator is connected. This is seen in FIG. 5 where the transformer 18, in addition to the primary winding 182 and the secondary winding 184 feeding the electrostatic receiver 16, has another secondary winding 184' feeding another receiver 16'. Any number of electrostatic receivers may be provided each fed by a separate secondary winding.

Naturally, this other high frequency generator may alternatively be connected to another transformer having a primary winding connected in parallel with the transformer 18 and thus in series with the capacitor 20. Alternatively, the other transformer may be connected in series with another capacitor and this assembly be connected in parallel with the transformer/capacitor 18/20, if desired.

It is widely known that electrostatic sound generators, single-sided or not, require a high voltage to operate optimally. The function of the transformer 18 is to provide this high voltage. Using the transformer, lower requirements are put to e.g. an amplifier generating the signal fed to the transformer, so that this amplifier may be operated solely within its linear mode.

Driving the electrostatic sound generator, however, at or around the resonance frequency, less power and a lower high voltage is required to drive it. This means that less secondary windings may be required and that a thinner wire may be used in the transformer, whereby the transformer may be made much smaller. This enables the use of the assembly also in e.g. hearing aids.

The efficiency of the sound generator may be quantified by feeding a signal into the transformer (FIG. 2) and correlating the voltage applied with the sound pressure generated under certain circumstances, such as when fed from the output 169 into one end of a cylinder 170, where the sound pressure is then determined at the other end of the cylinder. Preferably, no sound absorption takes place in the cylinder, the inner surface of which preferably is hard, such as made of a hard polymer/plastic/resin material and/or a metal or alloy.

Different set-ups of a high frequency generator 16, a low frequency generator 14 and a transformer 18 are illustrated in FIG. 3 within a housing 11 for positioning inside an ear canal of a person or partly therein, where the thicker part may be provided in the concha of the person. In FIG. 3A, the transformer 18 is provided in the thicker part and the generators in the thinner part. An element 111 may be used for shielding the generators from magnetic/electric fields of the transformer.

Connections between the transformer and generator 16 are not illustrated for clarity purposes. The circuit of FIG. 2 may be provided inside or outside the housing 11, if present at all. The generator 14 and the transformer 18 may receive a signal from outside the housing 11 such as via electrical connections (not illustrated) on the housing 11.

Figure 3A:
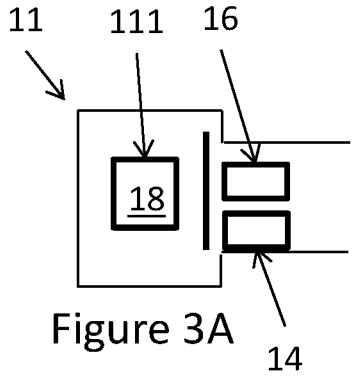
FIG. 3 illustrates different set-ups of an electrostatic sound generator, a second sound generator and a transformer in a housing
Figure 3B:
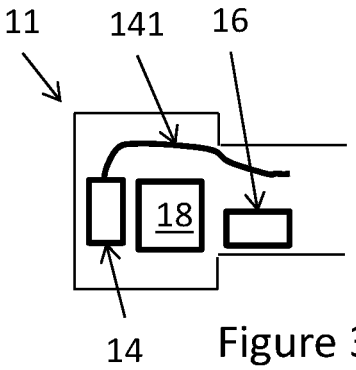

In FIG. 3B, the low frequency generator 14 is positioned behind the transformer 18 and outputs the sound to the output of the housing 11 via a channel 141.

As an alternative, this channel may be used for a high frequency sound generator, as an example of a tube 201 seen in FIG. 6/7, and thus be configured or dimensioned to adapt the resonance frequency of the sound generator.

Figure 3C:
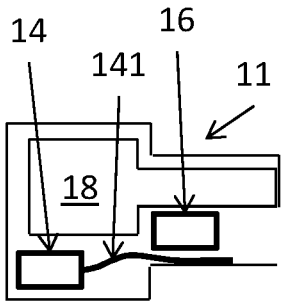

In FIG. 3C, the transformer has another shape and extends into the narrow portion of the housing 11. The generator 16 is provided in the thinner part and the generator 14 is provided in the thicker part from which it outputs its sound via a channel 141.

In general, the channel 141 may e.g. be a soft tube. The sound channel 141 may not be required. The sound from the generator 14 may find its own way around the generator 16 and out of the housing 11.

Figure 3D:
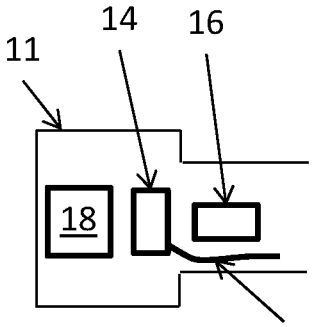

In FIG. 3D, compared to FIG. 3*b*, the positions of the transformer 18 and the generator 14 are swapped.

Figure 3E:
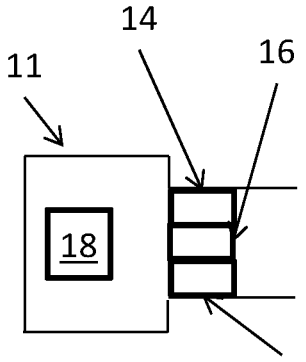

In FIG. 3E, compared to FIG. 3A, an additional high frequency generator 16' is provided, again in the narrow portion. The transformer 18 may be provided with two secondary windings each feeding a high frequency generator if desired. Alternatively, the same secondary winding may feed both high frequency generators.

Figure 3F:
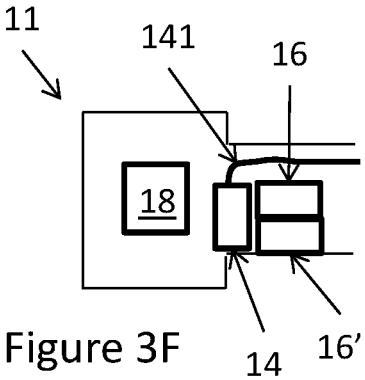

In FIG. 3F, compared to FIG. 3D, an additional high frequency generator 16' is provided, again in the narrow portion.

Figure 3G:
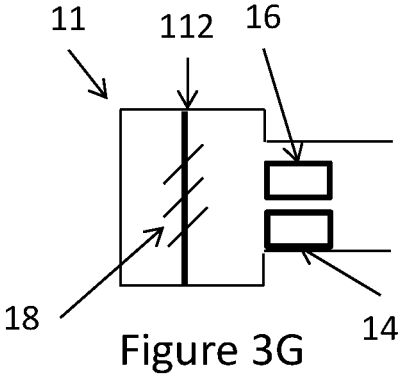

In FIG. 3G, compared to FIG. 3A, the transformer 18 is formed using a portion 112 of the housing 11. In this manner, the coils or conductors of the transformer 18 may be would around this portion 112.

Figure 4:
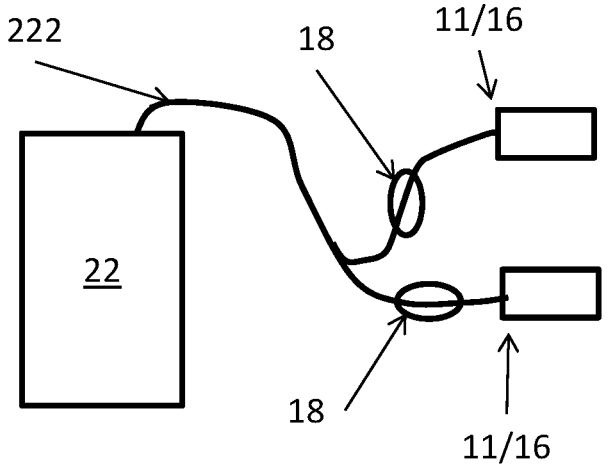
FIG. 4 illustrates an embodiment where two sound generators are connected to a mobile telephone for providing audio to a user

In FIG. 4, two sound generators 11/16 are illustrated connected by a wire 222 to a mobile telephone 22. The sound generators 11/16 comprise at least electrostatic sound generators 16 but may also comprise low frequency sound generators 14 if desired.

Naturally, the corresponding transformers may be provided (see FIG. 3) in the housings at 11/16 but may also be provided in the wire 222 as illustrated.

Using the phone 22 to provide the signal for the transformers and/or the generators 11/16, the signal output by the telephone may be adapted in any desired manner. Also, a microphone (not illustrated) may be provided in or at the generators 11/16 and the signal therefrom fed to the telephone 22 in order for the telephone to monitor the sound output of the generators 11/16 in order to automatically adjust the signals if desired. Such adjustment may be frequency response, for example.

The invention claimed is:

1. An assembly comprising a transformer and a sound generator, the sound generator comprising a housing, a diaphragm and a back plate, the housing having a volume of no more than 100 $mm^3$, and wherein the diaphragm divides an inner space of the housing into a first and a second volume, the back plate is positioned in one of the first and second volumes, the backplate positioned no more than 50 μm from the diaphragm, the diaphragm has a resonance frequency in the interval of 1 kHz-14 kHz, the transformer being positioned outside of the housing and having a first conductor, having a wire diameter of 20-100 μm, and a second conductor having a wire diameter of 50 μm or less, the second conductor being connected to the sound generator, the first conductor having a first number of windings and the second conductor having a second number of windings, where a ratio of the first number of windings to the second number of windings is lower than 1:5000, the transformer having a volume of 300 $mm^3$ or less.

2. An assembly according to claim 1, wherein the back plate is a single back plate.

3. An assembly according to claim 2, the sound generator further comprising a signal input and a conducting area provided on or in one of the back plate and the diaphragm, the conducting area comprising a charge, where the signal input is connected to the other of the back plate and the diaphragm.

4. An assembly according to claim 1, further comprising a second back plate positioned in the other of the first and second volumes, the diaphragm being positioned between the back plate and the other back plate.

5. An assembly according to claim 4, the sound generator further comprising a signal input, a first conducting area comprising a first charge and a second conducting area comprising a second charge, where the first conducting area is provided on or in a first of the diaphragm, the back plate and the second back plate, the signal input is connected to a second of the diaphragm, the back plate and the second back plate, and the second conducting area is provided on or in a third of the diaphragm, the back plate and the second back plate.

6. An assembly according to claim 1, wherein the first conductor comprises no more than 1000 windings and the second conductor has no less than 10000 windings.

7. An assembly according to claim 1, further comprising a low frequency sound generator, the low frequency sound generator being configured to output sound in the frequency interval of 20 Hz-10 kHz.

8. An assembly according to claim 7, further comprising a medium frequency sound generator, the medium frequency sound generator being configured to output sound in the frequency interval of 200 Hz-12 kHz.

9. An assembly according to claim 1, further comprising a second sound generator comprising a second housing, a second diaphragm and a second back plate, wherein the second diaphragm divides an inner space of the second housing into a third and a fourth volume, the second back plate is positioned in one of the third and fourth volumes, the second diaphragm has a resonance frequency in the interval of 2 kHz-12 kHz, the second generator being connected to the second conductor and in parallel or in series with the first sound generator.

10. An assembly according to claim 9, further comprising a third housing comprising therein the housing and the second housing and having a sound outlet.

11. An assembly according to claim 1, further comprising a signal emitter comprising an amplifier with an operating voltage below 10V, the signal emitter being configured to feed a signal with a frequency in the interval of 1-20 kHz to the first conductor.

12. A method of operating an assembly comprising a transformer and a sound generator, the sound generator comprising a housing, a diaphragm and a back plate, the housing having a volume of no more than 100 $mm^3$, and wherein the diaphragm divides an inner space of the housing into a first and a second volume, the back plate is positioned in one of the first and second volumes, the backplate positioned no more than 50 μm from the diaphragm, the diaphragm has a resonance frequency in the interval of 2 kHz 12 kHz, the transformer being positioned outside of the housing and having a first conductor, having a wire diameter of 20-100 μm, and a second conductor, the second conductor being connected to the sound generator, the first conductor having a first number of windings and the second conductor having a second number of windings, where a ratio of the first number of windings to the second number of windings is lower than 1:5000, the transformer having a volume of 300 $mm^3$ or less, the method comprising the step of feeding an electrical signal having a maximum voltage of 10V and comprising at least a portion within the frequency interval of 1-20 kHz to the first conductor.

13. The method according to claim 12, wherein the sound generator housing has a portion configured to be positioned at or in an ear canal of a person, the sound generator having a sound output in the portion, the feeding step comprising:

feeding an AC signal to the first conductor and feeding a sound signal from the sound output into one end of a cylindrical cavity with a diameter of 18.55 mm and a length of 6.6 mm, the sound signal having, at the other end of the cavity, at least 80 dB/V.

14. A method according to claim 12, wherein the diaphragm has a resonance frequency in the interval of 2 kHz-12 kHz and wherein the feeding step comprises removing or damping undesired frequencies below 2 kHz below the resonance frequency.

* * * * *